US011832647B2

(12) United States Patent
Mironov et al.

(10) Patent No.: US 11,832,647 B2
(45) Date of Patent: Dec. 5, 2023

(54) MOULDED CARTRIDGE ASSEMBLY

(71) Applicant: PHILIP MORRIS PRODUCTS S.A., Neuchatel (CH)

(72) Inventors: Oleg Mironov, Cudrefin (CH); Jerome Christian Courbat, Cortaillod (CH); Enrico Stura, Palezieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 604 days.

(21) Appl. No.: 17/053,913

(22) PCT Filed: May 24, 2019

(86) PCT No.: PCT/EP2019/063537
§ 371 (c)(1),
(2) Date: Nov. 9, 2020

(87) PCT Pub. No.: WO2019/224382
PCT Pub. Date: Nov. 28, 2019

(65) Prior Publication Data

US 2021/0195962 A1 Jul. 1, 2021

(30) Foreign Application Priority Data

May 25, 2018 (EP) ..... 18174380

(51) Int. Cl.
*A24F 40/40* (2020.01)
*A24F 40/48* (2020.01)
(Continued)

(52) U.S. Cl.
CPC ..... *A24F 40/40* (2020.01); *A24F 40/42* (2020.01); *A24F 40/48* (2020.01); *A24F 40/10* (2020.01); *A24F 40/70* (2020.01)

(58) Field of Classification Search
None
See application file for complete search history.

(56) References Cited

U.S. PATENT DOCUMENTS 11,433,193 B2 * 9/2022 Rogan ..... A61M 11/042
2014/0305454 A1 10/2014 Rinker
(Continued)

FOREIGN PATENT DOCUMENTS

CA 3017429 12/2017
CN 204519357 8/2015
(Continued)

OTHER PUBLICATIONS

Office Action issued in Russia for Application No. 2020139812/03 dated May 30, 2022 (14 pages). English translation included.
(Continued)

*Primary Examiner* — Oscar C Jimenez
(74) *Attorney, Agent, or Firm* — Mueting Raasch Group

(57) ABSTRACT

There is provided a cartridge (300) for a handheld aerosol-generating system, comprising: a cartridge body (305) comprising an outer wall (325) and an inner airflow tube (320) within the outer body, wherein the inner airflow tube is spaced from the outer wall; and a reservoir (340) of aerosol-forming substrate between the outer wall and the inner airflow tube; wherein the outer wall and inner airflow tube are connected to one another through one or more ribs (326) extending between the outer wall and inner airflow tube, and wherein the outer wall, inner airflow tube and one or more ribs are integrally moulded. With this arrangement a robust cartridge can be inexpensively and reliably manufactured. The ribs provide mechanical support between the outer wall and the inner airflow tube. The integral moulding of the outer wall, inner airflow tube and one or more ribs can ensure or minimise leakage of liquid from the cartridge.

14 Claims, 4 Drawing Sheets

(51) Int. Cl.

| | |
|---|---|
| ***A24F 40/42*** | (2020.01) |
| ***A24F 40/10*** | (2020.01) |
| ***A24F 40/70*** | (2020.01) |

(56) References Cited

U.S. PATENT DOCUMENTS

| | | | | |
|---|---|---|---|---|
| 2016/0021934 | A1 | 1/2016 | Cadieux | |
| 2016/0128388 | A1 | 5/2016 | Liu | |
| 2016/0353801 | A1 | 12/2016 | Zinovik | |
| 2018/0125120 | A1 | 5/2018 | Gavrielov | |
| 2018/0242643 | A1* | 8/2018 | Silvesstrini | A24F 40/46 |
| 2021/0145063 | A1* | 5/2021 | Perrins | A24F 40/46 |
| 2022/0175034 | A1* | 6/2022 | Papakyrillou | A24D 1/20 |

FOREIGN PATENT DOCUMENTS

| | | |
|---|---|---|
| EP | 3143882 | 3/2017 |
| RU | 2131750 | 6/1999 |
| WO | WO 2016/096733 | 12/2015 |
| WO | WO 2017/129616 | 8/2017 |
| WO | WO 2017/207416 | 12/2017 |
| WO | WO 2018/069675 | 4/2018 |

OTHER PUBLICATIONS

International Preliminary Examination Report for PCT/EP2019/063537 dated Dec. 10, 2020 (7 pages).
Extended European Search Report for Application No. 18174380.8 dated Nov. 29, 2018 (13 pages).
Search Report and Written Opinion for PCT/EP2019/063537 dated Aug. 21, 2019 (9 pages).

* cited by examiner

MOULDED CARTRIDGE ASSEMBLY

This application is a U.S. National Stage Application of International Application No. PCT/EP2019/063537 filed May 24, 2019, which was published in English on Nov. 28, 2019 as International Publication No. WO 2019/224382 A1. International Application No. PCT/EP2019/063537 claims priority to European Application No. 18174380.8 filed May 25, 2018.

The invention relates to handheld aerosol-generating systems, and in particular to systems that comprise a cartridge containing an aerosol-forming substrate and an airflow passage through the cartridge.

One widely used type of handheld aerosol-generating system operates by heating a liquid aerosol-forming substrate to generate an aerosol. The liquid aerosol-forming substrate may be provided in a cartridge than attaches to or is received in a main body component of the system, which contains a power supply. A heater may be provided as part of the main body component, or as part of the cartridge, or both.

To form an aerosol, the liquid vaporised by the heater must be entrained in an airflow and cooled within the airflow. In systems that generate aerosol for user inhalation, the airflow is typically generated by the user drawing or puffing on a mouthpiece component of the system. The airflow must pass the heater. A common arrangement is to have a rotationally symmetric cartridge with an airflow passage formed through a centre of the cartridge. This makes locating the cartridge relative to the main body component simple for users.

However, this arrangement brings challenges. In particular, it is important that the liquid in the cartridge is prevented from leaking from the cartridge both before and during use. At the same time, the cartridge must be straightforward to fill. This is typically accomplished using multiple components in the cartridge, including elastomeric sealing elements.

But cartridges may also desirably be disposable items. This prevents refilling with unsuitable liquids, ensures good hygiene and provides user convenience. Disposable cartridges may need to be produced in high volume. Accordingly, it would could be desirable to be able to manufacture cartridges that are inexpensive, simple to assemble and robust.

In a first aspect of the invention, there is provided a cartridge for a handheld aerosol-generating system, comprising:

- a cartridge body comprising an outer wall and an inner airflow tube within the outer body, wherein the inner airflow tube is spaced from the outer wall; and
- a reservoir of aerosol-forming substrate between the outer wall and the inner airflow tube;
- wherein the outer wall and inner airflow tube are connected to one another through one or more ribs extending between the outer wall and inner airflow tube, and wherein the outer wall, inner airflow tube and one or more ribs are integrally moulded.

With this arrangement a robust cartridge can be inexpensively and reliably manufactured. The ribs provide mechanical support between the outer wall and the inner airflow tube. The integral moulding of the outer wall, inner airflow tube and one or more ribs can minimise leakage of liquid from the cartridge.

Preferably, the one or more ribs extending between the outer wall and inner airflow tube comprise" a plurality of ribs that pass through the reservoir. The cartridge may comprise two, three, four or more ribs. The ribs may be symmetrically disposed around the inner airflow tube. The ribs may divide the reservoir into a plurality of separate compartments. The one or more ribs may extend a full length of the cartridge or may extend over only a portion of the length of the cartridge. The outer wall may be generally cylindrical and the one or more ribs may extend radially inward from the outer wall to the inner airflow tube.

The cartridge body may comprise a sealing element that seals the inner airflow tube, wherein the sealing element is integrally moulded with the airflow tube. In this context, "seals the inner airflow tube" means that that air cannot pass completely through the inner airflow tube from one end to an opposite end.

The cartridge may comprise a heater assembly comprising a heating element, wherein the heater assembly is fixed to the cartridge body. The heater assembly may be fixed to the cartridge body by a mechanical interlock. This allows the cartridge body to be filled with liquid aerosol-forming substrate and subsequently for the heater assembly to be fixed to the cartridge body.

The heater assembly may comprise a heater assembly body, wherein the heater assembly body is moulded around the heating element. The heating element may be fluid permeable. Fluid permeable in this context means that vapour can escape through the heating element. To allow this, the heating element may comprise apertures or pores though which vapour can pass. For example, the heating element may comprise a mesh or fabric of electrically resistive filaments. Alternatively, or in addition, the heating element may comprise a sheet with holes or slots in it. The resistive heating element may comprise a plurality of interstices or apertures extending from the second side to the first side and through which fluid may pass.

The heating element may be a resistive heating element, which is supplied directly with an electrical current in use. The resistive heating element may comprise a plurality of electrically conductive filaments. The term "filament" is used throughout the specification to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The resistive heating element may be an array of filaments, for example arranged parallel to each other. Preferably, the filaments may form a mesh. The mesh may be woven or non-woven. The mesh may be formed using different types of weave or lattice structures. Alternatively, the resistive heating element consists of an array of filaments or a fabric of filaments.

The filaments may define interstices between the filaments and the interstices may have a width of between 10 micrometres and 100 micrometres. Preferably, the filaments give rise to capillary action in the interstices, so that in use, liquid to be vaporized is drawn into the interstices, increasing the contact area between the heating element and the liquid aerosol-forming substrate.

The filaments may form a mesh of size between 60 and 240 filaments per centimetre (+/−10 percent). Preferably, the mesh density is between 100 and 140 filaments per centimetres (+/−10 percent). More preferably, the mesh density is approximately 115 filaments per centimetre. The width of the interstices may be between 100 micrometres and 25 micrometres, preferably between 80 micrometres and 70 micrometres, more preferably approximately 74 micrometres. The percentage of open area of the mesh, which is the ratio of the area of the interstices to the total area of the mesh may be between 40 percent and 90 percent, preferably between 85 percent and 80 percent, more preferably approximately 82 percent.

The filaments may have a diameter of between 8 micrometres and 100 micrometres, preferably between 10 micrometres and 50 micrometres, more preferably between 12 micrometres and 25 micrometres, and most preferably approximately 16 micrometres. The filaments may have a round cross section or may have a flattened cross-section.

The area of the filaments may be small, for example less than or equal to 50 square millimetres, preferably less than or equal to 25 square millimetres, more preferably approximately 15 square millimetres. The size is chosen such to incorporate the heating element into a handheld system. The heating element may, for example, be rectangular and have a length between 2 millimetres to 10 millimetres and a width between 2 millimetres and 10 millimetres.

The filaments of the heating element may be formed from any material with suitable electrical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group.

Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Timetal® is a registered trade mark of Titanium Metals Corporation. The filaments may be coated with one or more insulators. Preferred materials for the electrically conductive filaments are stainless steel and graphite, more preferably 300 series stainless steel like AISI 304, 316, 304L, 316L. Additionally, the electrically conductive heating element may comprise combinations of the above materials. A combination of materials may be used to improve the control of the resistance of the substantially flat heating element. For example, materials with a high intrinsic resistance may be combined with materials with a low intrinsic resistance. This may be advantageous if one of the materials is more beneficial from other perspectives, for example price, machinability or other physical and chemical parameters. Advantageously, a substantially flat filament arrangement with increased resistance reduces parasitic losses. Advantageously, high resistivity heaters allow more efficient use of battery energy.

Preferably, the filaments are made of wire. More preferably, the wire is made of metal, most preferably made of stainless steel.

The electrical resistance of the filaments of the heating element may be between 0.3 Ohms and 4 Ohms. Preferably, the electrical resistance is equal or greater than 0.5 Ohms. More preferably, the electrical resistance the heating element is between 0.6 Ohms and 0.8 Ohms, and most preferably about 0.68 Ohms.

Alternatively, the heating element may comprise a heating plate in which an array of apertures is formed. The apertures may be formed by etching or machining, for example. The plate may be formed from any material with suitable electrical properties, such as the materials described above in relation to filaments of a heating element.

The heating element may be a susceptor element. As used herein, a "susceptor element" means a conductive element that heats up when subjected to a changing magnetic field. This may be the result of eddy currents induced in the susceptor element and/or hysteresis losses. Advantageously the susceptor element is a ferrite element. The material and the geometry for the susceptor element can be chosen to provide a desired electrical resistance and heat generation.

The susceptor element may be a ferrite mesh susceptor element. Alternatively, the susceptor element may be a ferrous susceptor element.

The susceptor element may comprise a mesh. As used herein the term "mesh" encompasses grids and arrays of filaments having spaces therebetween, and may include woven and non-woven fabrics.

The mesh may comprise a plurality of ferrite or ferrous filaments. The filaments may define interstices between the filaments and the interstices may have a width of between 10 μm and 100 μm. Preferably the filaments give rise to capillary action in the interstices, so that in use, liquid to be vapourised is drawn into the interstices, increasing the contact area between the susceptor element and the liquid.

The filaments may form a mesh of size between 160 and 600 Mesh US (+/−10%) (i.e. between 160 and 600 filaments per inch (+/−10%)). The width of the interstices is preferably between 75 μm and 25 μm. The percentage of open area of the mesh, which is the ratio of the area of the interstices to the total area of the mesh is preferably between 25 and 56%. The mesh may be formed using different types of weave or lattice structures. Alternatively, the filaments consist of an array of filaments arranged parallel to one another.

The filaments may have a diameter of between 8 μm and 100 μm, preferably between 8 μm and 50 μm, and more preferably between 8 μm and 40 μm.

The area of the mesh may be small, preferably less than or equal to 500 mm2, allowing it to be incorporated in to a handheld system. The mesh may, for example, be rectangular and have dimensions of 15 mm by 20 mm.

Advantageously, the susceptor element has a relative permeability between 1 and 40000. When a reliance on eddy currents for a majority of the heating is desirable, a lower permeability material may be used, and when hysteresis effects are desired then a higher permeability material may be used. Preferably, the material has a relative permeability between 500 and 40000. This provides for efficient heating.

The heating element may have a thickness substantially smaller than its length or width. The heating element may have a thickness an order of magnitude smaller than its length or width. The heating element may be generally planar. The heating element may be annular or otherwise curved.

The reservoir advantageously contains a liquid retention material. The liquid retention material may be in contact with the heating element. The liquid retention material may be a capillary material. A capillary material is a material that actively conveys liquid from one end of the material to another. The capillary material is advantageously oriented in the housing to convey liquid to the heating element.

The liquid retention material may have a fibrous or spongy structure. The liquid retention material may comprise a bundle of capillaries. For example, the liquid retention material may comprise a plurality of fibres or threads or other fine bore tubes. The fibres or threads may be generally aligned to convey liquid to the heater. Alternatively, the liquid retention material may comprise sponge-like or foam-like material. The structure of the liquid retention material may form a plurality of small bores or tubes, through which the liquid can be transported by capillary action. The liquid retention material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The liquid retention material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the liquid retention material by capillary action.

The outer wall of the cartridge body may comprise a mouthpiece portion configured for insertion into a user's mouth.

The aerosol-forming substrate may be a liquid or a gel at room temperature.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may comprise homogenised tobacco material. The aerosol-forming substrate may comprise a non-tobacco-containing material. The aerosol-forming substrate may comprise homogenised plant-based material.

The aerosol-forming substrate may comprise one or more aerosol-formers. An aerosol-former is any suitable known compound or mixture of compounds that, in use, facilitates formation of a dense and stable aerosol and that is substantially resistant to thermal degradation at the temperature of operation of the system. Examples of suitable aerosol formers include glycerine and propylene glycol. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. The aerosol-forming substrate may comprise water, solvents, ethanol, plant extracts and natural or artificial flavours.

The aerosol-forming substrate may comprise nicotine and at least one aerosol former. The aerosol former may be glycerine or propylene glycol. The aerosol former may comprise both glycerine and propylene glycol. The liquid aerosol-forming substrate may have a nicotine concentration of between about 0.5% and about 10%, for example about 2%.

In a second aspect, there is provided a handheld aerosol-generating system comprising a cartridge according to any one of the preceding claims and a main body connected to the cartridge, wherein the main body comprises a power supply.

The handheld aerosol-generating system may comprise a mouthpiece portion separate to the cartridge, the mouthpiece portion comprising a piercing member configured to pierce a sealing element in the cartridge upon relative movement between the mouthpiece portion and the sealing element. The sealing element may be positioned to cover or block the airflow tube. The sealing element may reduce loss of aerosol-forming substrate from the cartridge prior to use. The sealing element may also prevent or reduce contaminants entering the cartridge prior to use. The sealing element may be integrally moulded with the cartridge body.

The main body may comprise an induction coil and a oscillator circuit configured to provide an oscillating current to the inductor coil. The induction coil may be a helical coil, the inductor coil may be placed within the susceptor or may surround the susceptor. The inductor coil may be a pancake coil positioned adjacent to the susceptor, The cartridge may attach to the main body using any suitable fitting. For example, a screw fitting may be used. A push fitting or a mechanical interlock may be used. A magnetic attachment means may be used.

The main body may comprise control circuitry connected to the power supply. The control circuitry may comprise a microcontroller. The microcontroller is preferably a programmable microcontroller. The control circuitry may comprise further electronic components. The control circuitry may be configured to regulate a supply of power to the heating element. Power may be supplied to the heating element continuously following activation of the system or may be supplied intermittently, such as on a puff-by-puff basis. The power may be supplied to the aerosol-generating element in the form of pulses of electrical current. The control circuitry may include an airflow sensor and the control circuitry may supply electrical power to the heating element when user puffs are detected by the airflow sensor.

The aerosol-generating system may comprise a mouthpiece through which a user can inhale aerosol generated by the aerosol-generating system.

The aerosol-generating system may comprise an airflow passage extending from an air inlet, past the vaporiser assembly to an outlet. The airflow passage may comprise the inner airflow tube. The outlet may be in a mouthpiece. The air inlet may be positioned in the cartridge, in the main body or may be defined between the cartridge and the main body or between the mouthpiece and the main body.

The aerosol-generating system may have a size comparable to a conventional cigar or cigarette. The aerosol-generating system may have a total length between about 30 mm and about 150 mm. The aerosol-generating system may have an external diameter between about 5 mm and about 30 mm.

The power supply may be a DC power supply. The power supply may be a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The power supply may be another form of charge storage device such as a capacitor. The power supply may require recharging and be configured for many cycles of charge and discharge. The power supply may have a capacity that allows for the storage of enough energy for one or more user experiences; for example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the atomiser assembly.

In operation, a user may activate the system by puffing on a mouthpiece or providing some other user input, for example by pressing a button on the system. The control circuitry then supplies power to the heating element power for a predetermined time period or for the duration of a user puff. The heating element then heats the liquid in the liquid transport medium to form a vapour that escapes from the vaporiser assembly into an air flow passage through the system. The vapour cools and condenses for form an aerosol that is then drawn into the user's mouth.

In a third aspect, there is provided a method of manufacturing a cartridge for a handheld aerosol-generating system, the handheld aerosol-generating system, the method comprising:

moulding a cartridge body comprising an outer wall and an inner airflow tube within the outer body, wherein the inner airflow tube is spaced from the outer wall and wherein the outer wall and inner airflow tube are connected to one another through one or more ribs extending between the outer wall and inner airflow tube, from an injection mouldable polymer; and filling a cavity between the outer wall and the inner airflow tube with an aerosol-forming substrate; and fixing a heater assembly comprising a heating element to the cartridge body to cover an open end of the cavity.

Features described in relation to one aspect of the invention may be applied to other aspects of the invention. In particular features of the cartridge and system of the first and second aspects of the invention may be present in the cartridge and system of the third aspect of the invention.

Embodiments of the invention will now be described in detail, by way of example only, with reference to the drawings, in which:

FIG. 1 is a schematic illustration of an aerosol-generating system in accordance with the invention;

FIG. 2*a* is a cross section view of a cartridge in accordance with a first embodiment of the invention;

FIG. 2*b* is a different cross section through the cartridge of FIG. 2*a;*

FIG. 2*c* illustrates a separator plate of the cartridge of FIG. 2*a;*

FIG. 2*d* illustrates a floor plate of the cartridge of FIG. 2*a;*

DESCRIPTION OF INVENTION

Figure 1:
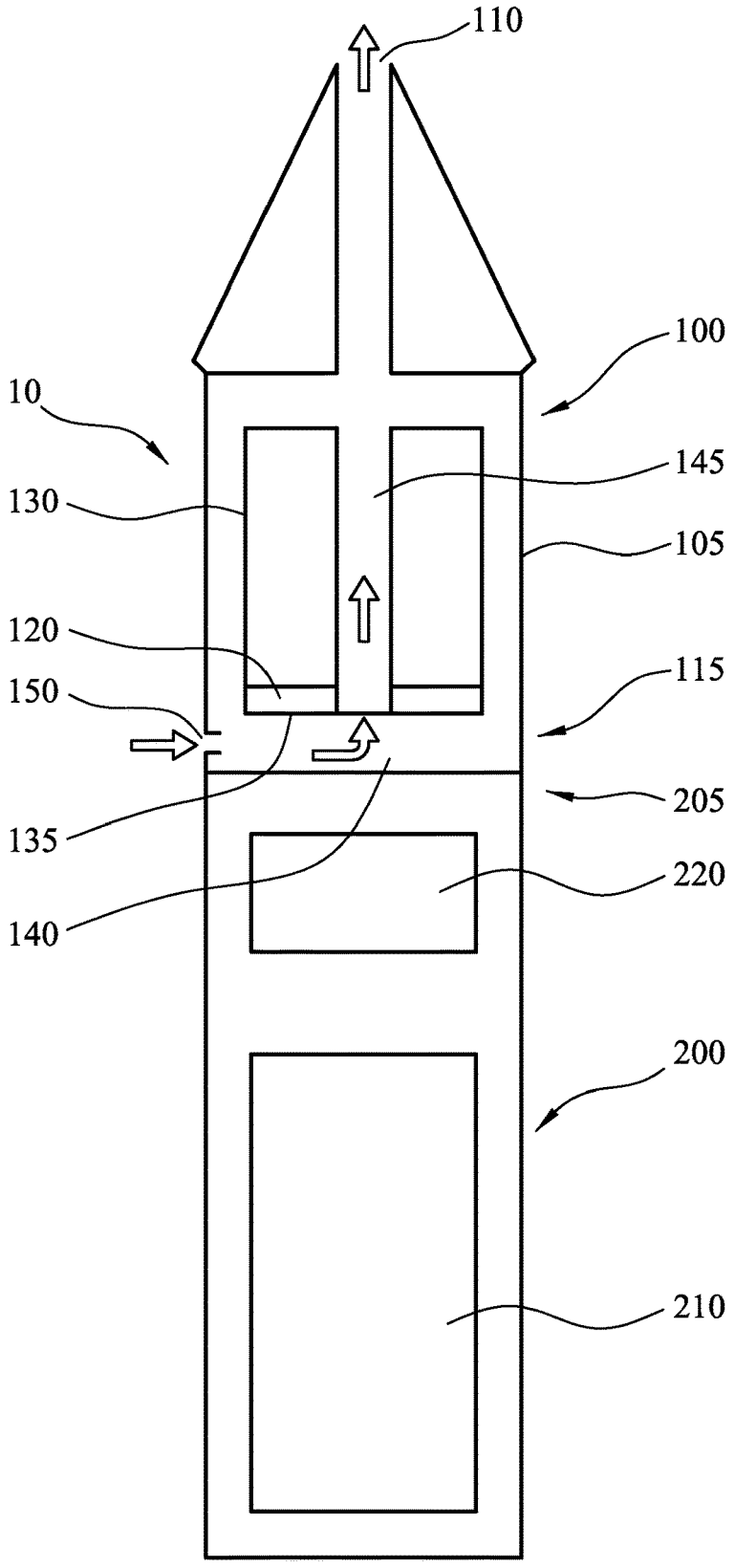

FIG. 1 is a schematic illustration of an aerosol-generating system in accordance with a first embodiment of the invention. The system comprises two main components, a cartridge 100 and a main body 200. A connection end 115 of the cartridge 100 is removably connected to a corresponding connection end 205 of the main body 200. The main body contains a battery 210, which in this example is a rechargeable lithium ion battery, and control circuitry 220. The aerosol-generating device 10 is portable and has a size comparable to a conventional cigar or cigarette.

The cartridge 100 comprises a housing 105 containing an heater assembly 120 and a liquid storage compartment 130 defining a liquid supply reservoir. A liquid aerosol-forming substrate is held in the liquid storage compartment. The heater assembly is connected to a bottom end of the liquid storage compartment. The heater assembly comprises a heating element 135, in the form of a fluid permeable mesh. In this example the heater assembly is provided as part of the cartridge, but in some embodiments it may be fully or partially provided as part of the main body. Alternatively, the heating assembly may be provided fully or partially in a separate component, typically referred to as an atomiser.

As will be described, the heating element may take different forms. The heating element may be configured to be heated by an induction process or may be configured to be heated by directly passing an electrical current from the control circuitry through it. An airflow passage 140, 145 extends through the system from an air inlet 150 past the heating element 135 and from the heating element to a mouth end opening 110 in a mouthpiece portion of the housing 105. The airflow passage passes through the centre of the cartridge, through the liquid supply reservoir. In this example the mouthpiece portion is an integral part of the cartridge, but in some embodiments it may be provided as a separate component.

The system is configured so that a user can puff or suck on the mouthpiece portion of the cartridge to draw aerosol into their mouth. In operation, when a user puffs on the mouth end opening, air is drawn through the airflow passage from the air inlet, past the heating element, to the outlet. The control circuitry controls the supply of electrical power from the battery 210 to the heating element. This in turn controls the temperature of the heating element and so the amount and properties of the vapour produced by the heater assembly. The control circuitry may include an airflow sensor. The control circuitry may supply electrical power to the coil when user puffs on the cartridge are detected by the airflow sensor. This type of control arrangement is well established in aerosol-generating systems such as inhalers and e-cigarettes. So when a user sucks on the mouthpiece end of the cartridge, the heater assembly is activated and generates a vapour that is entrained in the air flow passing through the air flow passage 140. The vapour cools with in the airflow in passage 145 to form an aerosol, which is then drawn into the user's mouth through the mouth end opening 110.

Figure 2A:
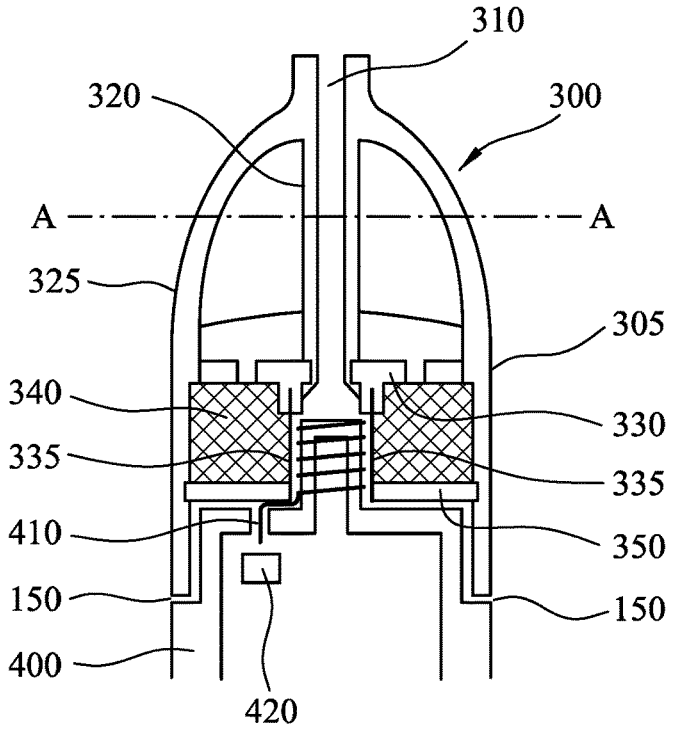

FIG. 2*a* is a cross section of a first embodiment of a cartridge 300 in accordance with the invention, shown together with a connection end of the main body 400 of the system. The embodiment of FIG. 2*a* operates on the principle of inductive heating. Inductive heating works by placing an electrically conductive article to be heated in a time varying magnetic field. Eddy currents are induced in the conductive article. If the conductive article is electrically isolated the eddy currents are dissipated by Joule heating of the conductive article. In an aerosol-generating system that operates by heating an aerosol-forming substrate, the aerosol-forming substrate is typically not itself sufficiently electrically conductive to be inductively heated in this way. In the embodiment shown in FIGS. 2*a-d* a susceptor element 335 is used as the conductive article that is heated. The aerosol-forming substrate is then heated by the susceptor element by thermal conduction, convection and/or radiation. If a ferromagnetic susceptor element is used, heat is also generated by hysteresis losses as the magnetic domains are switched within the susceptor element.

The embodiment shown in FIGS. 2*a-d* uses an inductor coil 410 in the main body to generate a time varying magnetic field. The inductor coil is designed so that it does not undergo significant Joule heating. In contrast, the susceptor element is designed so that there is significant Joule heating of the susceptor.

The oscillating magnetic field passes through the susceptor element, inducing eddy currents in the susceptor element. The susceptor element heats up as a result of Joule heating, and as a result of hysteresis losses, reaching a temperature sufficient to vapourise the aerosol-forming substrate close to the susceptor element. The vapourised aerosol-forming substrate is entrained in the air flowing from the air inlet to the air outlet, as explained in more detail below, and cools to form an aerosol within the mouthpiece portion before entering the user's mouth. The control electronics supplies the oscillating current to the coil for a predetermined duration, in this example five seconds, after detection of a puff, and then switches the current off until a new puff is detected.

Figure 2B:
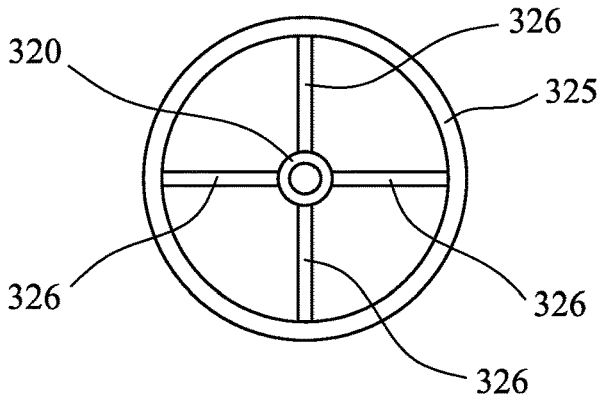

In the embodiment of FIG. 2*a* the cartridge 300 comprises a moulded cartridge body 305 formed from an injection mouldable polymer, such as polyetheretherketone (PEEK). The moulded cartridge body comprises an outer wall 325 and an inner airflow tube 320, which meet at a mouth end 310 of the cartridge. Four ribs 326 extend between the outer wall 325 and the inner airflow tube. The ribs 326 are integrally moulded with the outer body and inner airflow tube. The ribs 326 are shown in FIG. 2*b*, which is a section through the cartridge in the plane A-A shown in FIG. 2*a*. It can be seen that the cartridge body has a generally round cross-section.

Figure 2C:
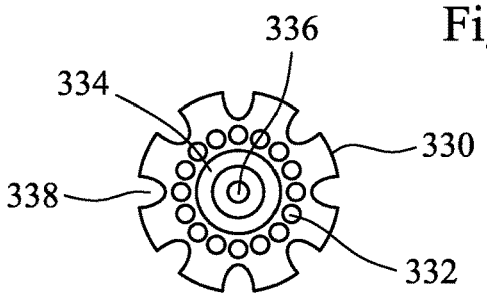

A first support plate 330, which may also be formed from PEEK, is inserted into the cartridge body and is located to provide additional support between the inner airflow tube and the outer wall. The first support plate 330 is shown in FIG. 2*c*. The end of the inner airflow tube, which is the end remote from the mouthpiece end, is located in a central aperture of the first support plate. The periphery of the first support plate comprises notches 338, which locate against corresponding features in the inner surface of the outer wall of the cartridge body. The first support plate comprises a plurality of apertures 332 formed through it, which allow for the passage of liquid aerosol-forming substrate through the first support plate. The first support plate also comprises an annular protrusion 334, extending away from the mouth end. The protrusion 334 supports a susceptor element 335.

The susceptor element comprises an annular, stainless steel mesh that extends around a central cavity. The susceptor is fluid permeable and in particular is configured to allow vapour to pass through it. The central cavity is configured to receive the inductor coil 410, in use. The central cavity also forms a part of the airflow channel through the system, as will be described.

A liquid retention material or capillary material 340 is positioned within the cartridge on a distal side of the first support plate. The liquid retention material 340 is in contact with the susceptor. The function of the liquid retention material is to ensure that some liquid aerosol-forming substrate is in contact with the susceptor regardless of the orientation of the system. The liquid retention material in this example is a woven glass fibre material.

Figure 2D:
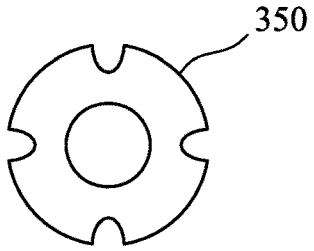

A second support plate 350 is fixed to the outer wall and to the susceptor to retain the liquid retention material and to support the susceptor. The second support plate 350 is shown in FIG. 2*d*. An aperture is formed in the centre of the second support plate, sized to receive the coil 410. The periphery of the second support plate comprises notches, which locate against corresponding features in the inner surface of the outer wall of the cartridge body.

The space between the outer wall, the inner airflow tube, the susceptor element and the second support plate is filled with liquid aerosol-forming substrate. The liquid aerosol-forming substrate is a mixture of an aerosol-former, such as glycerine, with water, nicotine and flavour compounds.

In operation, when the user draws on the mouth end 310 of the cartridge, air is drawn in through air inlets 150 defined between the main body and the cartridge and into the central cavity of the cartridge. The air passes between the coil 410 and the susceptor 335 before being drawn through the inner airflow tube 320. The user inhalation is detected by puff sensor 420. The user inhalation causes a pressure drop in a cavity in fluid communication with the airflow path. Upon detection of a user inhalation, the control circuitry supplies a high frequency current to the coil so that the susceptor 335 is inductively heated. The aerosol-forming substrate in the vicinity of the susceptor is vapourised and passes through the susceptor into the central cavity. The vapour is drawn through the inner airflow tube 320 with the air, and cools to form an aerosol before entering the user's mouth.

A cartridge constructed in this way is robust and means that there is minimal possibility of leakage of liquid aerosol forming substrate, particularly at the mouth end of the system, without needing separate liquid sealing elements.

Figure 3:
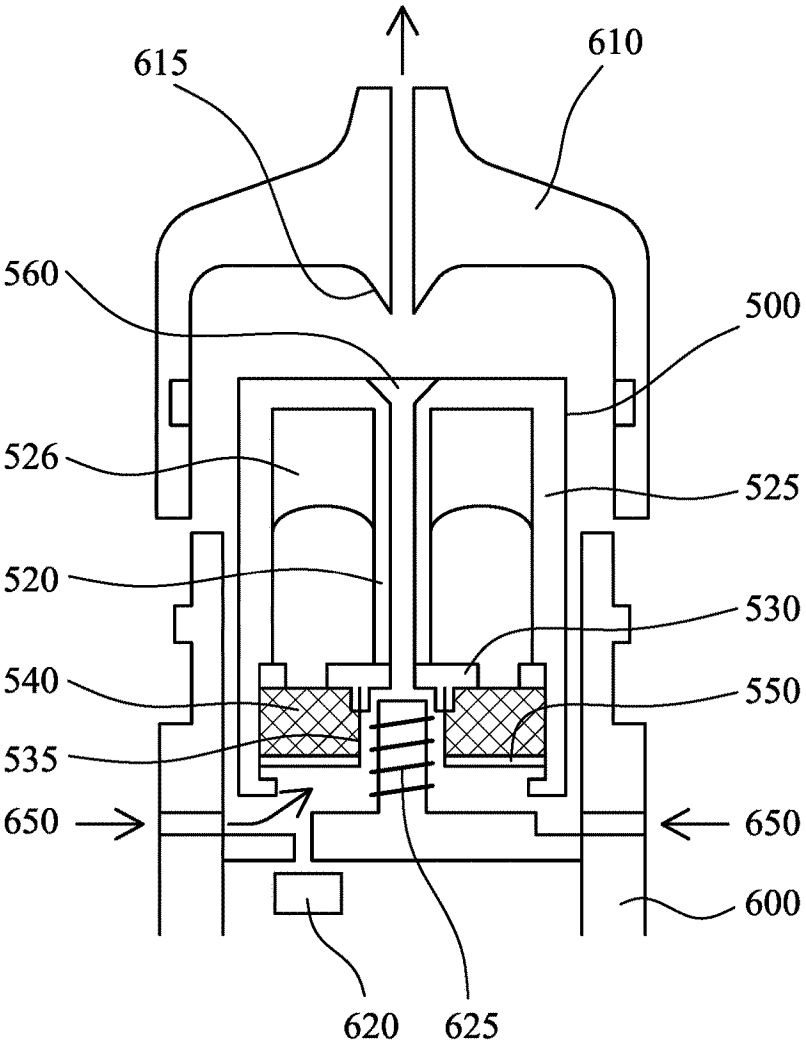
FIG. 3 is a cross section of a cartridge in accordance with a second embodiment of the invention.

FIG. 3 is an illustration of another embodiment in accordance with the invention. The system of FIG. 3 is similar to the system of FIG. 2, but in the embodiment of FIG. 3, a mouthpiece is provided as separate component to the cartridge. The system of FIG. 3 comprises a cartridge 500 held between a main body 600 and a mouthpiece 610. The embodiment of FIG. 3 operates on the principle of inductive heating in the same manner as the embodiment of FIG. 2*a*.

The cartridge 500 comprises the a moulded cartridge body formed from an injection mouldable polymer, such as polyetheretherketone (PEEK). The moulded cartridge body comprises an outer wall 525 and an inner airflow tube 520, which meet at a mouth end of the cartridge. Four ribs 526 extend between the outer wall 525 and the inner airflow tube 520. The ribs 526 are integrally moulded with the outer body and inner airflow tube and have the same configuration as the ribs of FIG. 2*b*. The cartridge body has a generally round cross-section.

The cartridge of FIG. 3 comprises a first support plate 530 and a second support plate 550 in the same manner as the embodiment of FIG. 2*a*. An susceptor element 535 is provided in the same manner as the embodiment of FIG. 2*a*. The susceptor element comprises an annular, stainless steel mesh that extends around a central cavity. A liquid retention material or capillary material 540 is positioned within the cartridge on a distal side of the first support plate. The liquid retention material 540 is in contact with the susceptor element 535.

The mouth end of the cartridge comprises a sealing element 560. The sealing element 560 covers and seals the inner airflow tube 520. The sealing element is a thin membrane that can be ruptured by a piercing detail 615 on the mouthpiece 610.

The sealing element 560 may be formed with the cartridge body in an injection moulding process. In particular the sealing element may be formed with the central airflow tube, which may be considered as a boss, with the sealing element being the bottom of the boss.

In an injection moulding process, there is a shrinking effect when the walls of an injection moulded product are not of uniform thickness. Thicker walls solidify more slowly than thinner walls meaning that parts attached to thicker walls will sink into the thicker wall or shrink. This effect, usually considered a problem, can be used to an advantage in the present invention, by making the sealing element very thin and easy to pierce.

The opposite end of the cartridge may also be sealed by a sealing element that is peeled off by the user prior to use.

The main body 600 of the embodiment of FIG. 3 has a similar structure to the main body of FIG. 2*a* but is configured to engage the mouthpiece 610 to enclose the cartridge.

The main body includes an inductor coil 625 and a puff detector 620. Air inlets 650 are provided through the housing of the main body 600.

The cartridge is placed in a cavity in the main body 600 so that the susceptor element 535 is adjacent to the inductor coil 625. The mouthpiece is then placed over the cartridge and engages the main body 600. The mouthpiece may attach to the main body by a snap-fit connection or a screw connection, for example. The mouthpiece thus retains the cartridge in position. When the mouthpiece is connected to the main body, the piercing detail 615 pierces the sealing element 560 on the cartridge.

In use, a user puffs on the mouthpiece to draw air through the system. When the user draws on the mouthpiece 610, air is drawn in through air inlets 650 into the central cavity of the cartridge. The air passes between the coil 625 and the susceptor element 535 before being drawn through the inner airflow tube 520. The user inhalation is detected by puff sensor 620. Upon detection of a user inhalation, the control circuitry supplies a high frequency current to the coil so that the susceptor element 535 is inductively heated. The aerosol-forming substrate in the vicinity of the susceptor is vapourised and passes through the susceptor into the central cavity. The vapour is drawn through the inner airflow tube 520 with the air, and cools to form an aerosol before entering the user's mouth.

Figure 4:
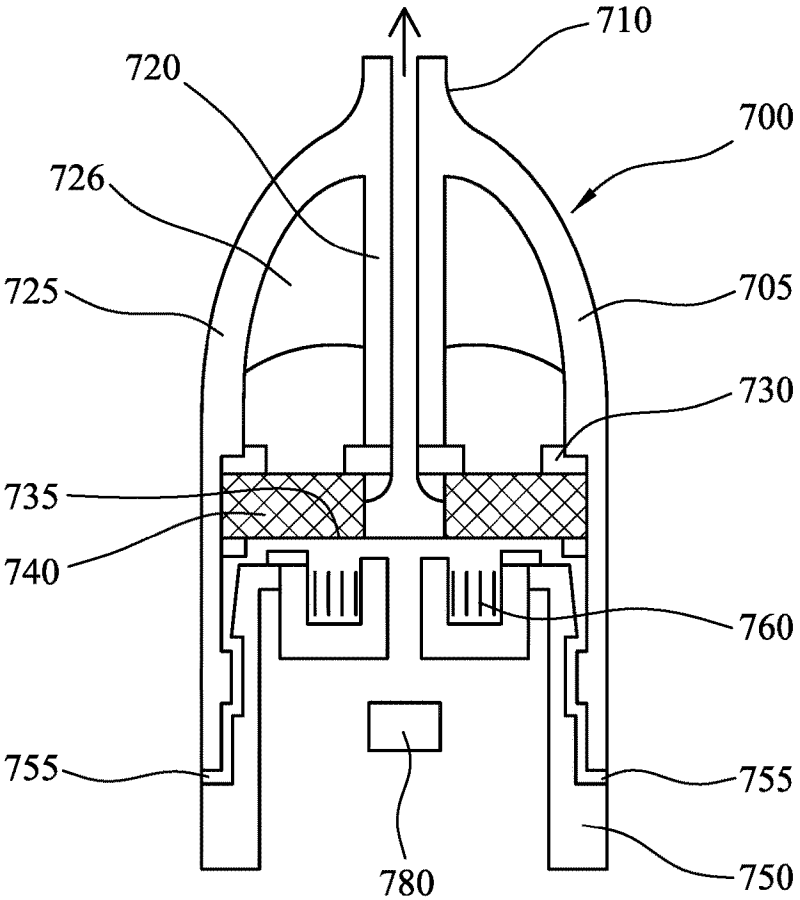
FIG. 4 is a cross section of a cartridge in accordance with a third embodiment of the invention.

FIG. 4 is an illustration of another embodiment in accordance with the invention. The system of FIG. 4 is similar to the system of FIG. 2, and works using same principle of inductive heating, but in the embodiment of FIG. 4 there is a different arrangement of the susceptor element and coil.

In the embodiment of FIG. 4 the cartridge 700 comprises a moulded cartridge body 705 formed from an injection mouldable polymer, such as polyetheretherketone (PEEK). The moulded cartridge body comprises an outer wall 725 and an inner airflow tube 720, which meet at a mouth end 710 of the cartridge. Four ribs 726 extend between the outer wall 725 and the inner airflow tube. The ribs 726 are integrally moulded with the outer body and inner airflow tube in the same manner as shown in FIG. 2*b*. The cartridge body 705 has a generally round cross-section.

A first support plate 730, which may also be formed from PEEK and has a similar form to the first support plate of FIG. 2*c*, is inserted into the cartridge body and is located to provide additional support between the inner airflow tube and the outer wall. The end of the inner airflow tube, which is the end remote from the mouthpiece end, is located in a central aperture of the first support plate 740.

The susceptor element 735 comprises an flat stainless steel mesh that is parallel to the first support plate 730. The susceptor is fluid permeable and in particular is configured to allow vapour to pass through it. Between the first support plate and the susceptor element, there is a liquid retention material 740. The liquid retention material 740 is in contact with the susceptor element. The function of the liquid retention material is to ensure that some liquid aerosol-forming substrate is in contact with the susceptor element regardless of the orientation of the system. The liquid retention material in this example is a woven glass fibre material. The liquid retention material has a central aperture formed through it, in alignment with the central airflow tube 720, to allow for the passage of air through the cartridge.

The space between the outer wall and the inner airflow tube and susceptor element is filled with liquid aerosol-forming substrate. The liquid aerosol-forming substrate is a mixture of an aerosol-former, such as glycerine, with water, nicotine and flavour compounds.

In the main body 750 of the embodiment of FIG. 4, a pancake inductor coil 760 is used. The pancake inductor coil is positioned adjacent to the susceptor element 735. The pancake coil is held within a ferrous flux concentrator.

As in the embodiment of FIG. 2*a*, in operation, when the user draws on the mouth end 710 of the cartridge, air is drawn in through air inlets 755 defined between the main body and the cartridge. The air passes between the coil 760 and the susceptor element 735 before being drawn through the susceptor element and through inner airflow tube 720. The user inhalation is detected by puff sensor 780. The user inhalation causes a pressure drop in a cavity in fluid communication with the airflow path. Upon detection of a user inhalation, the control circuitry supplies a high frequency current to the coil so that the susceptor element 735 is inductively heated. The aerosol-forming substrate in the vicinity of the susceptor element is vapourised. The vapour is drawn through the inner airflow tube 720 with the air, and cools to form an aerosol before entering the user's mouth.

Figure 5:
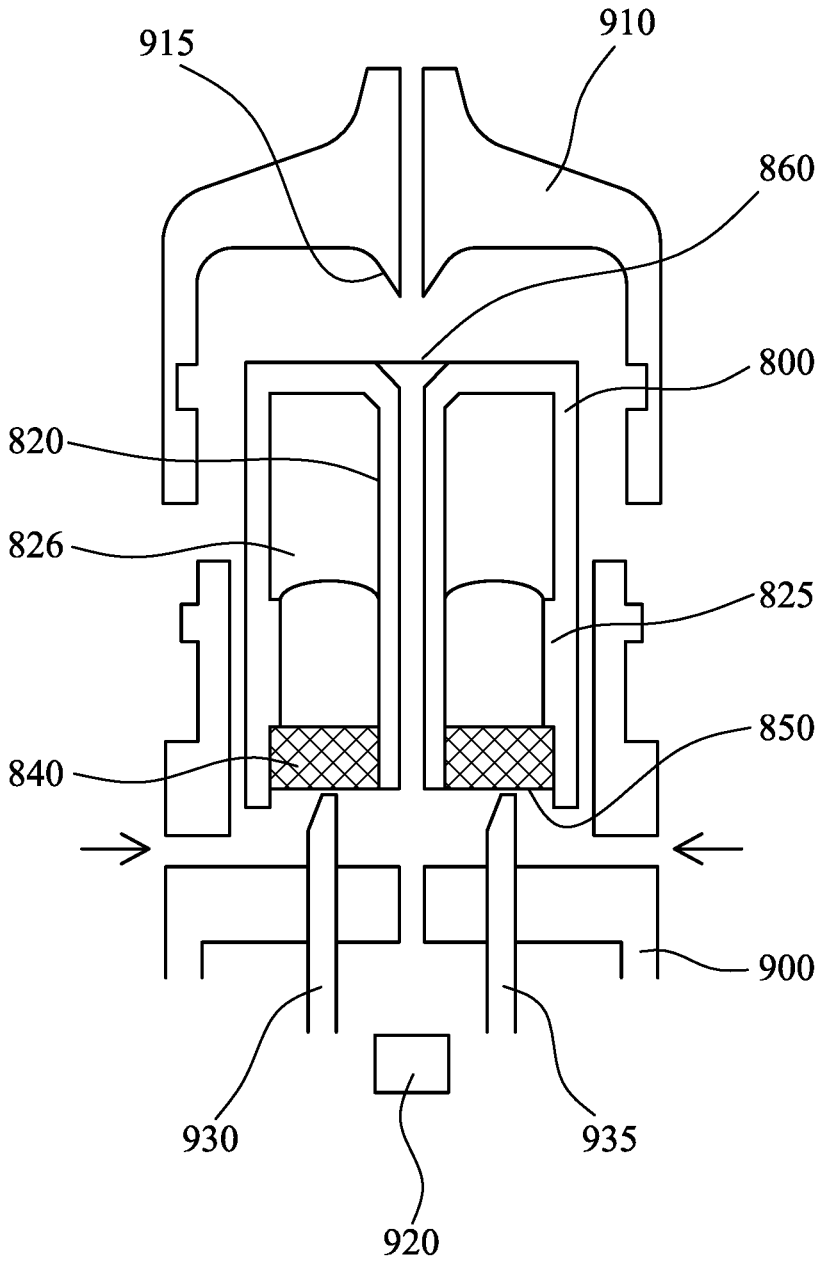
FIG. 5 is a cross section of a cartridge in accordance with a fifth embodiment of the invention.

FIG. 5 is a further embodiment of the invention, using resistive heating rather than inductive heating. The system of FIG. 5 is similar to the system of FIG. 3 in that the mouthpiece is separate to the cartridge.

The cartridge 800 comprises the a moulded cartridge body formed from an injection mouldable polymer, such as polyetheretherketone (PEEK). The moulded cartridge body comprises an outer wall 825 and an inner airflow tube 820, which meet at a mouth end of the cartridge. Four ribs 826 extend between the outer wall 825 and the inner airflow tube 820. The ribs 826 are integrally moulded with the outer body and inner airflow tube and have the same configuration as the ribs of FIG. 2*b*. The cartridge body has a generally round cross-section.

The cartridge of FIG. 5 comprises resistive heating element 850 at end opposite the mouth end. The heating element comprises planar stainless steel mesh that is vapour permeable. An aperture is formed in the heating element, aligned with the central airflow tube 920. The heating element may be part of a heater assembly that is glued or mechanically secured to the moulded cartridge body.

A liquid retention material or capillary material 840 is positioned within the cartridge on a distal side of the first support plate. The liquid retention material 840 is in contact with the heating element 850. The space between the moulded cartridge body and the heating element is filled with a liquid aerosol-forming substrate, as described in relation to the previous embodiments.

The mouth end of the cartridge comprises a sealing element 860. The sealing element 860 covers and seals the inner airflow tube 820. The sealing element is a thin membrane that can be ruptured by a piercing detail 915 on the mouthpiece 910, as described with reference to FIG. 3.

The opposite end of the cartridge may also be sealed by a sealing element that is peeled off by the user prior to use.

The main body 900 of the embodiment of FIG. 5 has a similar structure to the main body of FIG. 3 but includes a pair of spring loaded electrical contact pins 930, 935 in place of an inductor coil. The electrical contact pins contact the heating element 850 and provide a current through the heating element so as to generate heat.

A puff detector 920 is provided to detect user puffs. Air inlets are provided through the housing of the main body 900.

The cartridge is placed in a cavity in the main body 600 so that the heating element 835 contacts the electrical contact pins 930, 935. The mouthpiece 910 is then placed over the cartridge and engages the main body 900. The mouthpiece attaches to the main body by a snap-fit connection. The mouthpiece thus retains the cartridge in position. When the mouthpiece is connected to the main body, the piercing detail 915 pierces the sealing element 860 on the cartridge.

In use, a user puffs on the mouthpiece to draw air through the system. When the user draws on the mouthpiece 910, air is drawn in through air inlets 950. The air passes between the heating element 835 before being drawn through the inner airflow tube 820. The user inhalation is detected by puff sensor 920. Upon detection of a user inhalation, the control circuitry supplies a current to the heating element so that it is heated by the Joule effect. The aerosol-forming substrate in the vicinity of the heating element is vapourised and passes through the heating element into the airflow. The vapour is drawn through the inner airflow tube 820 with the air, and cools to form an aerosol before entering the user's mouth.

It should be clear that the described embodiments are merely examples of the invention and that modifications may be made. In particular different shapes of cartridge and different materials may be used.

The invention claimed is:

1. A cartridge for a handheld aerosol-generating system, comprising: a cartridge body comprising an outer wall, an inner airflow tube within an outer body, and a sealing element that seals the inner airflow tube, such that that air cannot pass completely through the inner airflow tube from one end to an opposite end, wherein the sealing element is integrally moulded with the airflow tube and the inner airflow tube is spaced from the outer wall; and a reservoir of aerosol-forming substrate between the outer wall and the inner airflow tube; wherein the outer wall and inner airflow tube are connected to one another through one or more ribs extending between the outer wall and inner airflow tube, and wherein the outer wall, inner airflow tube and one or more ribs are integrally moulded.

2. A cartridge according to claim 1, wherein the one or more ribs extending between the outer wall and inner airflow tube comprise a plurality of ribs that pass through the reservoir.

3. A cartridge according to claim 1, wherein the outer wall is generally cylindrical and the one or more ribs extend radially inward from the outer wall to the inner airflow tube.

4. A cartridge according to claim 1, wherein the cartridge comprises a heater assembly comprising a heating element, wherein the heater assembly is fixed to the cartridge body.

5. A cartridge according to claim 4, wherein the heater assembly is fixed to the cartridge body by a mechanical interlock.

6. A cartridge according to claim 4, wherein the heater assembly comprises a heater assembly body, wherein the heater assembly body is moulded around the heating element.

7. A cartridge according to claim 4, wherein the heating element is a fluid permeable resistance heater.

8. A cartridge according to claim 4, wherein the heating element is a magnetic susceptor configured to heat the aerosol-forming substrate.

9. A cartridge according to claim 1, wherein the outer wall comprises a mouthpiece portion configured for insertion into a user's mouth.

10. A cartridge according to claim 1, wherein the aerosol-forming substrate is a liquid or a gel at room temperature.

11. A handheld aerosol-generating system comprising a cartridge according to claim 1 and a main body connected to the cartridge, wherein the main body comprises a power supply.

12. A handheld aerosol-generating system according to claim 11, comprising a mouthpiece portion, the mouthpiece portion comprising a piercing member configured to pierce a sealing element in the cartridge upon relative movement between the mouthpiece portion and the sealing element.

13. A handheld aerosol-generating system according to claim 11, wherein the main body comprises an induction coil and a oscillator circuit configured to provide an oscillating current to the inductor coil.

14. A method of manufacturing a cartridge for a handheld aerosol-generating system, the method comprising: moulding a cartridge body comprising an outer wall and an inner airflow tube within an outer body, wherein the inner airflow tube is spaced from the outer wall and wherein the outer wall and inner airflow tube are connected to one another through one or more ribs extending between the outer wall and inner airflow tube, from an injection mouldable polymer, wherein the cartridge body comprises a sealing element that seals the inner airflow tube, such that that air cannot pass completely through the inner airflow tube from one end to an opposite end, and the sealing element is integrally moulded with the airflow tube; and filling a cavity between the outer wall and the inner airflow tube with an aerosol-forming substrate; and fixing a heater assembly comprising a heating element to the cartridge body to cover an open end of the cavity.

* * * * *